United States Patent [19]

Watson

[11] Patent Number: 5,066,247

[45] Date of Patent: Nov. 19, 1991

[54] ELECTRICAL FITTING FOR PANEL CONSTRUCTION

[76] Inventor: James F. Watson, 240 Calle Cemlo, La Guacima de Alajuela, Costa Rica

[21] Appl. No.: 483,878

[22] Filed: Feb. 23, 1990

[51] Int. Cl.[5] ..... H01R 13/74

[52] U.S. Cl. ..... 439/565; 439/550; 248/27.1

[58] Field of Search ..... 439/527, 544, 545, 550, 439/562, 563, 565, 569, 572; 248/27.3, 27.1; 174/57

[56] References Cited

U.S. PATENT DOCUMENTS

| | | | |
|---|---|---|---|
| 2,664,132 | 12/1953 | Leverte | 439/550 |
| 2,744,185 | 5/1956 | Cawley | 248/27.3 |
| 2,869,094 | 1/1959 | Francis | 439/550 |
| 3,790,922 | 2/1974 | Normann | 439/563 |
| 4,407,042 | 10/1983 | Schramme et al. | 439/562 |
| 4,640,478 | 2/1987 | Leigh-Monstevens | 248/27.1 |
| 4,687,446 | 8/1987 | Birch et al. | 439/550 |
| 4,743,210 | 5/1988 | Schild et al. | 439/562 |

OTHER PUBLICATIONS

A Drawing of a "Conventional System", Filed on 2-2-3-90, Discussed Under the Background Section of the Instant Specification.

*Primary Examiner*—Gary F. Paumen
*Assistant Examiner*—Kevin J. Caroll
*Attorney, Agent, or Firm*—William F. Frank

[57] ABSTRACT

An electrical wiring system for use in construction of buildings consisting of fittings moulded of a dielectric material with internal circuitry and wire attachments that can be quickly and easily installed in round holes in panel materials of varying thicknesses by means of a metal clip. These fittings connected to each other with BX cable provide a foolproof installation that is impossible to short out and can be accomplished by labor not skilled in electrical wiring. Not only is the labor cost involved in installing this system reduced, but the material costs are also greatly reduced compared with the costs of conventional wiring.

6 Claims, 4 Drawing Sheets

ELECTRICAL FITTING FOR PANEL CONSTRUCTION

BACKGROUND

Since the very first electrical wiring installation, little has been done in this field to make it easier or less costly to install. In fact, what developements have been made have tended to make the installation more difficult and costly. This inventor recently applied for a patent which would reduce the cost of constructing a building shell using panels. However, the shell of a building is only part of the problem in reducing construction costs. To this end, there is presented the following electrical system for patent. To illustrate how the system simplifies the electrical wiring, there is provided a drawing FIG. 20 which compares the invention with a conventional, acceptable wiring installation FIG. 21. The conventional system shown has 62 separate pieces, each of which requires a manual operation as compared to my system of 13 parts.

SUMMARY

This invention relates to an electrical wiring system in any structure that permits the wiring to be run and the electrical fittings installed prior to the closing in of walls with panels or other wall finishes. The electrical fittings which are the subject of this present invention can be quickly installed in a circular hole in panels or laminas of various thicknesses without altering their physical shape and they can be retained in the panel or laminas by means of a clip that is slipped onto the fittings and these clips have the ability to adjust to slight variations in the panel or laminas. The installation of wiring and fittings can be accomplished by unskilled labor without special tools.

DETAILED DESCRIPTION OF THE DRAWINGS

Figure 1:
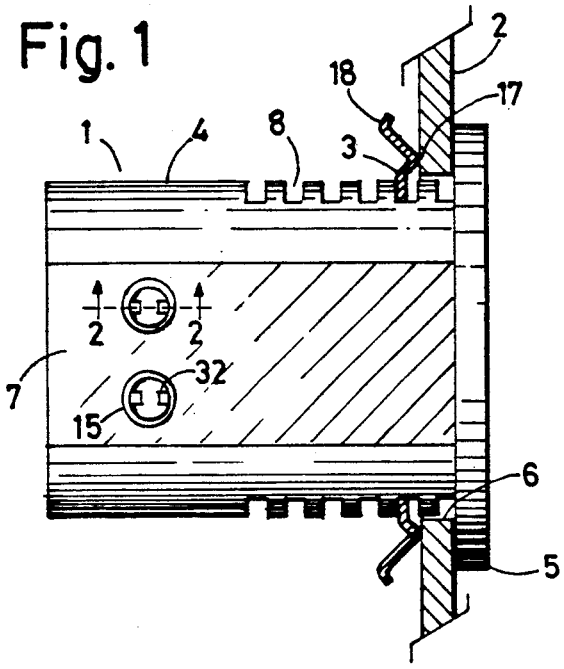
FIG. 1 A view of the fitting body showing the singular body conformation with its retaining shoulder opposing the retaining clip which holds the fitting in the panel.

FIG. 1 is a plan view of the electrical fitting 1 assembled in a panel 2 and retained in a hole 6 in the panel 2 by a clip 3. The electrical fitting 1 is made of a dielectric material containing a conductive electrical circuitry. This electrical fitting 1 has a basically cylindrical form 4 which terminates on the right-hand end with a flange 5 which is sufficiently larger than the cylindrical form 4 to prevent the fitting 1 from passing through the hole 6 in the panel 2. The cylindrical form 4 of the fitting 1 has diametrically opposed flats 7 extending the length of the cylindrical form 4 and in these flats 7 are wire sockets 15. The plane surface of these flats provide security against shorting when wire insulation is butted against the plane surface 7. At right angles to the flats 7 and diametrically opposed in the cylindrical form 4 are transversal grooves 8 spaced along the length of the cylindrical form 4 to provide adjustment in retaining the fitting 1 in panels of various thicknesses by means of the retaining clip 3. The grooves 8 are transversly long enough to accomodate the length of the leg 9 of the retaining clip 3 from the juncture of the plane central portion 10 of the clip 3 to the curved section 11 of the projection 12. The grooves 8 are sufficiently wide to allow the thickness of the clips plane edge 13 to freely pass through it. The depth of the grooves 8 at the top of the arc 14 formed by the groove 8 in the cylindrical form 4 of the fitting 1, is sufficiently deep to permit the plane edge 13 of the clip leg 9 to freely pass. Neither the transversal width of the flats 7 nor the length of the grooves 8 are so great as to destroy the basic cylindrical form 4 of the fitting 1 as it is essential to center the fitting 1 in the round hole 6 in the panel 2.

Figure 2:
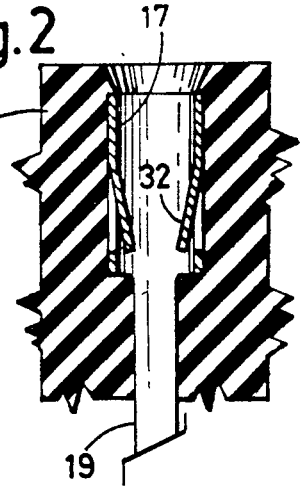
FIG. 2 is a section of the fitting which shows in cross section the contact and the pressure fingers.

FIG. 2 is a section through the wire socket 15 in the body of the fitting 1. The wire socket 15 is made of a tempered electrically conductive material and is cylindrically tubular with an inside diameter that is snug fit over the diameter of the wire size in the BX cable that the fitting 1 is designed for. In the wall of the tubular section 17 are fingers 32 projecting at a low angle inward into the tubular section 17 so that when a proper size wire is inserted into the socket, the wire contacts the sloping angle of the fingers 32 and force the fingers 32 outward and the tempered fingers 32 exert a pressure on the wire to retain it. Item 19 is a conductor that ties into the other circuitry within the fitting 1.

Figure 3:
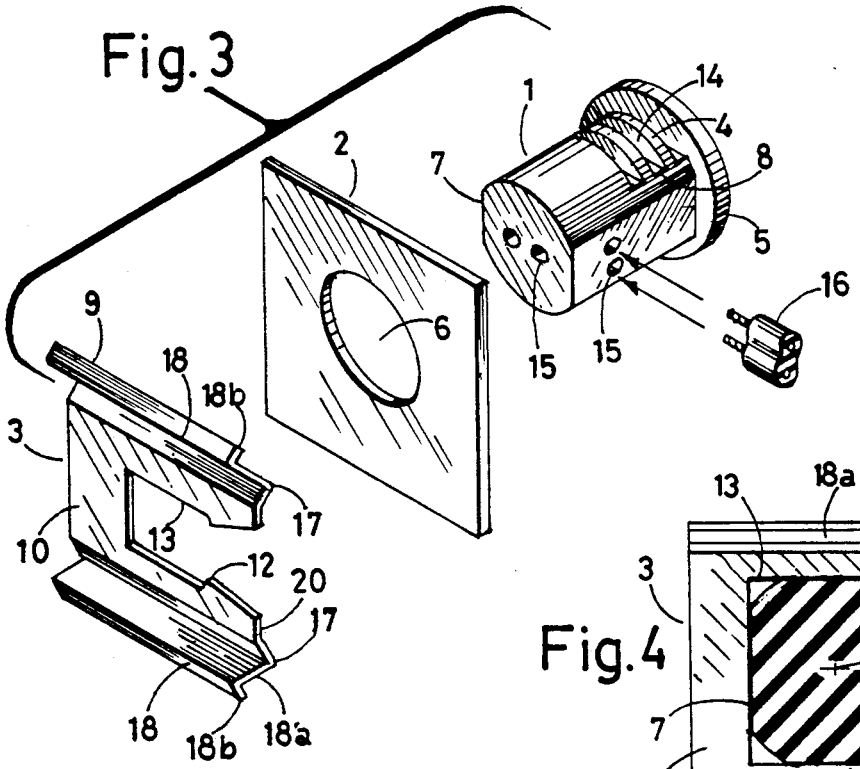
FIG. 3 is an exploded isometric showing the relationship of the fitting, the panel with a mounting hole, the retaining clip and a piece of BX cable.

FIG. 3 is an exploded isometric of the three basic units and shows more in detail the retaining clip 3. This clip 3 is made of a tempered material and is basically a "U" shape having a plane central portion 10 from which two parallel legs 9 extend outward. The distance between the parallel legs 9 is a slip fit over the distance between the bottoms of the transversal grooves 8 in the cylindrical form 4 of the fitting 1. The thickness of the clip 3 must be slip fit in the width of the grooves 8 in the cylindrical form 4 of the fitting 1. In each of the legs 9 are parallel ridges 17 and 18. Ridges 17 are located parallel to and adjacent to the plane edge 13 on the inside of the "U" of the clip 3. Where the ridges 17 are protruding upward from the plane edge 13 the ridges 18 are protruding downward from the plane edges 13 and are adjacent and parallel to ridges 17. The plane edges 13 extend along the inside of the "U" starting at their junctures with the plane central portion 10 and extend outward to the beginning of the radius 11 and this distance from the plane central portion 10 and the beginning of radius 11 is a distance 35 equal to the length of the grooves 8 in the cylindrical form 4 of the fitting 1 plus the distance from the termination of groove 8 to the flat 7 of the cylindrical form of the fitting 1. Radius 11 has the same radius point as the radius point of the radius forming the diameter of the cylindrical form 4 of the fitting 1. The projection 12 is only sufficiently high 36 as to act as a deterrent to the possibility of normal vibration backing it out of groove 8. From the high point of the projection 12 the edges 13 angle outward 38 to provide a sliding angle to ease the projection 12 through the grooves 8 by slightly springing the legs 9 outward when the clip 3 is forced through the grooves 8.

Figure 4:
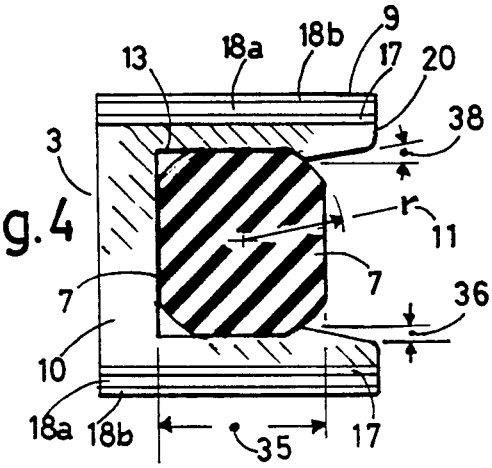
FIG. 4 is a plan of the retaining clip and section of the fitting body in detail.

FIG. 4 shows in plan the clip 3 and its relationship with the cylindrical form 4 of the fitting 1.

Figure 5:
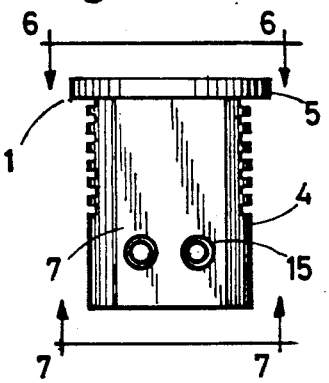
FIG. 5 A side view of the fitting body showing the location of the flats where the cable wires are inserted.

FIG. 5 is the previously described fitting 1 with integrated electrical circuitry for the fitting 1 to be used as a connector between fittings or appliances. This connector fitting 1 has a pair of wire sockets 15 on each of its flat surfaces and the distance between each socket in a pair is the same center-to-center distance of the wires in the BX cable 16 for which the fitting 1 was designed.

Figure 6:
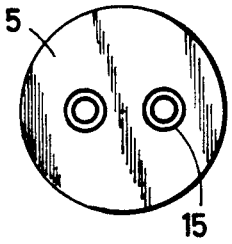
FIG. 6 is a top view of the fitting body, adapted for a connector.

FIG. 6 shows the pair of wire sockets 15 in the flange 5 end of the fitting 1.

Figure 7:
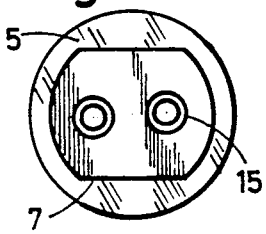
FIG. 7 is a view of the bottom of the fitting body adapted for a connector.

FIG. 7 shows the pair of wire sockets 15 in the cylindrical form 4 end of the fitting 1.

Figure 8:
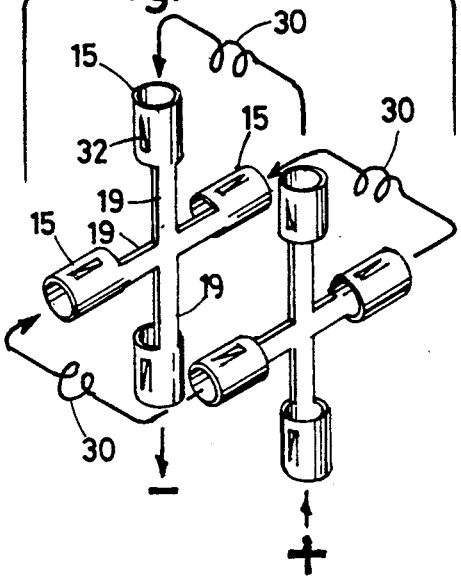
FIG. 8 is an isometric of the interior circuitry of the body adpated for a connector.

FIG. 8 illustrates in isometric form the hardware which can be seen to be in the form of two crosses or cruciforms that makes up the integrated circuitry. Item 30 represents an electrical load.

Figure 9:
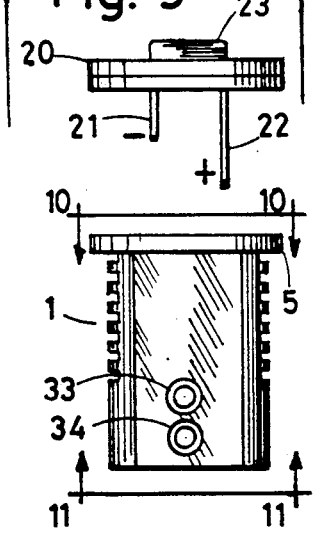
FIG. 9 illustrates the fitting body in the conformation for a switch.

FIG. 9 is the fitting 1 with integrated electrical circuitry for the fitting 1 to function as a switch. The fitting 1 has a pair of BX cable sockets 15 on the flat 7 and a second pair of sockets 15 on the flat end of the cylindrical form 4 of the fitting 1. On the flange 5 end of the fitting 1 is a pair of sockets 24 that are designed to accomodate the prongs of a standard electrical plug, but the contacts 26 and 27 inside the sockets are set at different levels. Reference 20 is a dielectric body that has integrated circuitry attached to a switch button 23 that opens and closes the switch 25 between the two prongs 21 and 22. The prongs 21 and 22 have centers permitting them to enter the standard sockets 24 in the fitting 1. The prongs 21 and 22 are of two prescribed lengths that when inserted in the sockets 24 in the fitting 1, they will make contact with the contacts 26 and 27 set at different prescribed levels to mate with the contacts 21 and 22.

Figure 10:
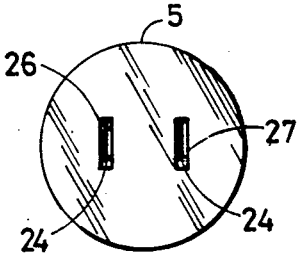
FIG. 10 is a top view of the fitting body adapted for a switch.

FIG. 10 illustrates the sockets 24 and integrated contacts 26 and 27 in the flange 5 end of the fitting 1.

Figure 11:
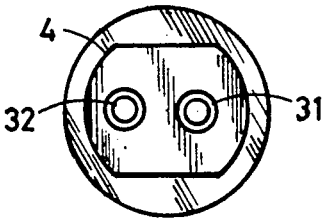
FIG. 11 is a bottom view of the fitting body adapted for a switch.

FIG. 11 illustrates the BX cable wire sockets in the end of the cylindrical form 4 of the fitting 1.

Figure 12:
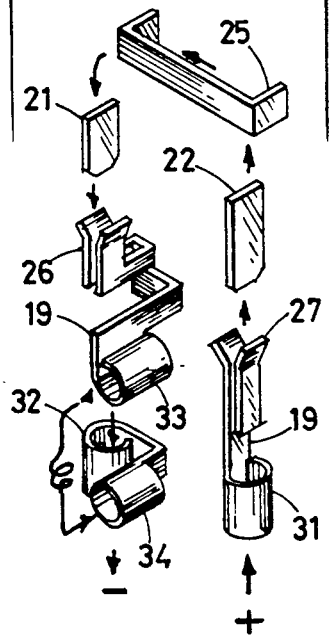
FIG. 12 is an exploded isometric of the interior circuitry of the fitting 1 adapted for a switch and shows the current flow in the circuitry.

FIG. 12 illustrates in exploded isometric form the hardware of the integrated circuitry and the current flow when the prongs 21 and 22 of the switch assembly 20 are inserted into the sockets 24 of fitting 1. Because the prongs 21 and 22 are of two different prescribed lengths and the fork-shaped contacts 26 and 27 are at prescribed levels in the integrated circuitry in the fitting 1, there is no possibility of improper coupling of the prongs 21 and 22 and the forked contacts 26 and 27 which would create a short in the circuitry. When all the parts illustrated in FIG. 12 are connected, the current flow is shown by arrows when an electrical current is introduced by inserting the bare ends of an electrically charged BX cable into wire sockets 31 and 32, thence the current flows through the forked contact 27, prong 22, switch 25, prong 21 and forked contact 26. When the bare wire ends of BX cable whose opposite end is connected to both sides of load represented in the isometric drawing as reference numeral 30, is inserted into the sockets 33 and 34 of the fitting 1, the load 30 is energized and the current goes to ground through socket 34. Having a separate switch 20 that plugs into a fitting 1 has the advantage that when a switch 20 is worn out, it is only necessary to replace the unit 20.

Figure 13:
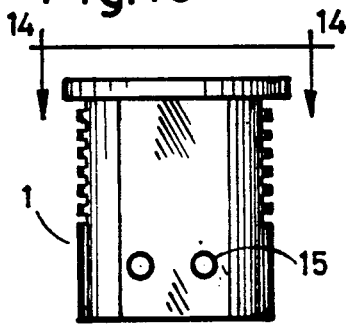
FIG. 13 is a side view of the a fitting body adpated for an outlet.

FIG. 13 shows a fitting 1 with integrated circuitry that makes it function as a wall outlet. Two pairs of BX cable sockets 24 and two contacts 26 for standard plug prongs are integrated into the fitting 1 body. One pair of cable wire sockets 15 are shown in flat 7 of the cylindrical form 4 of the fitting 1 to continue circuitry to other fittings.

Figure 14:
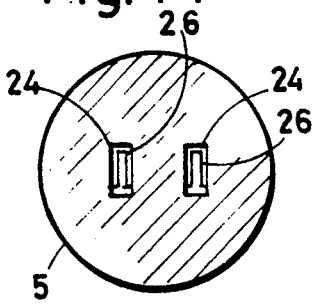
FIG. 14 is a top view of the fitting body adapted for an outlet.

FIG. 14 shows two standard sockets 24 in the flange 5 end of the fitting 1.

Figure 15:
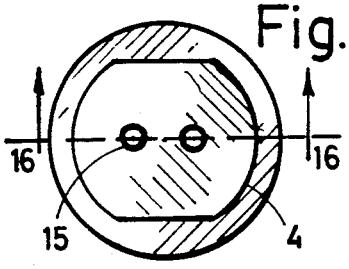
FIG. 15 is a bottom view of a fitting body adapted for an outlet.

FIG. 15 shows a pair of BX cable wire sockets 15 in the end of the cylindrically shaped form 4 of the fitting 1.

Figure 16:
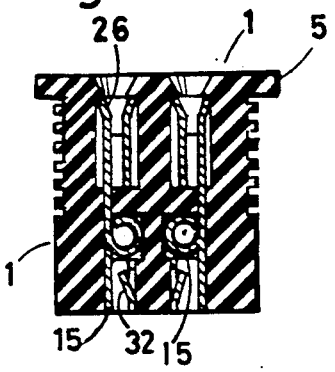
FIG. 16 shows the interior circuitry for a fitting body adapted for an outlet.

FIG. 16 is a section through the fitting 1 to show the circuitry to make the unit an outlet that can be used in parallel with other fittings.

Figure 17:
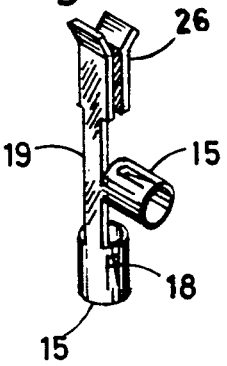
FIG. 17 is an isometric of the circuit hardware used to provide the circuitry for adapting the fitting body for an outlet.

FIG. 17 illustrates the hardware for the circuitry to make the fitting 1 function as an outlet that can be used in parallel with other fittings.

Figure 18:
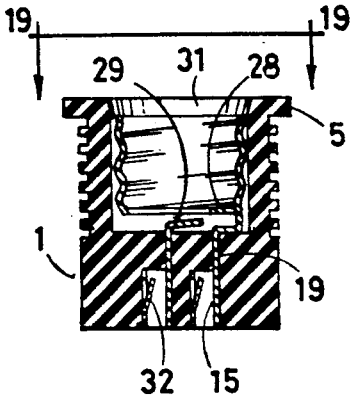
FIG. 18 is a section of a body fitting which shows the circuitry for adapting a fitting body for a light socket.
Figure 19:
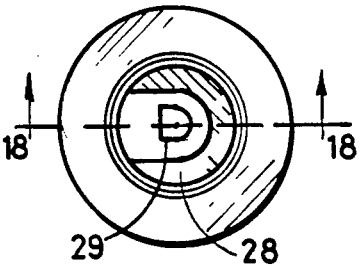
FIG. 19 is a top view of the fitting body showing the socket contact inside the threaded socket.
Figure 20:
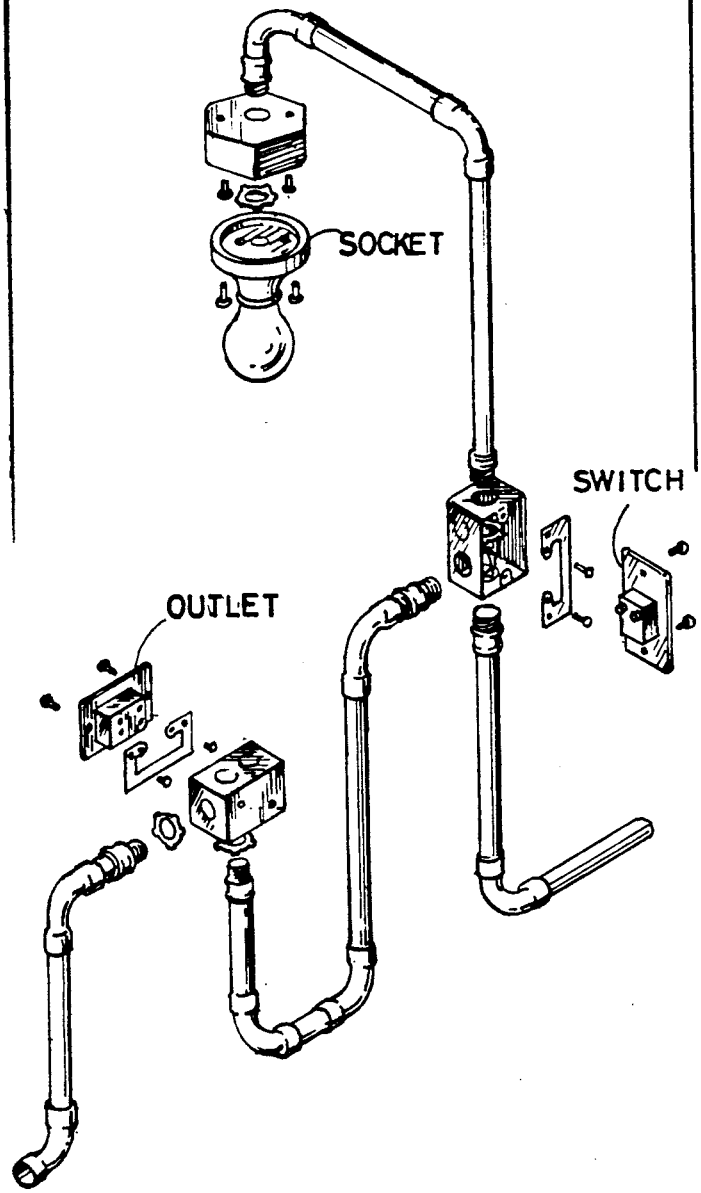
Fig. 20 PRIOR ART
FIG. 20 is an exploded view of conventional components of the prior art to provide the electrical system of FIG. 21.
Figure 21:
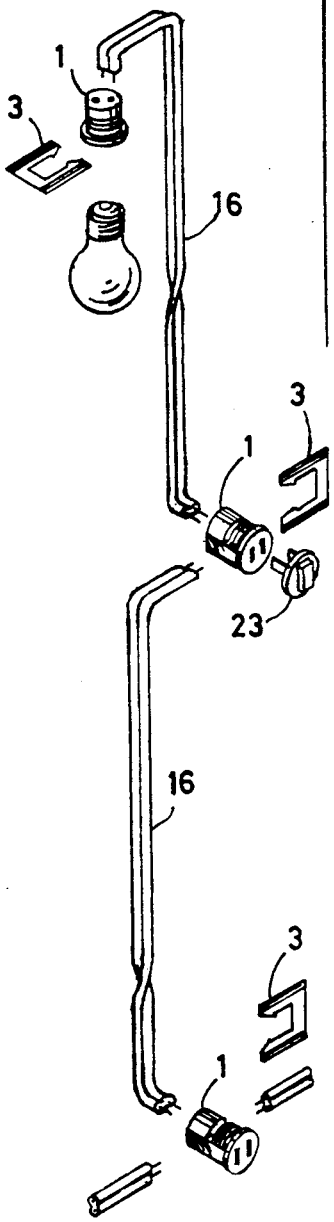
FIG. 21 is an exploded view of the present invention showing an electrical system comprising a light, a switch, an outlet and connecting electrical conduits.

FIG. 18 is a fitting 1 with integrated circuitry and hardware to function as a light socket. BX cable sockets 15 are in the end of the cylindrical form 4 and one of these sockets 15 is connected by a conductor 19 to a contact 29 centrally located in the base of the dielectric cavity 30 of the fitting 1. The cavity 30 is sufficiently deep to permit the full thread of a light bulb to enter plus a portion of the glass bulb to enter the cavity bevel 31 when the contact on the end of the bulb depresses the contact 29 in the cavity 30 of the fitting 1. The other socket 15 of the pair of sockets is connected to the threaded conductor 28 in the cavity by the connector 19 in the cavity 30.

I claim:

1. A multi-purpose electrical fitting adaptable for use as a connector, an outlet, a light socket or a switch comprising a basically cylindrical form having a pair of diametrally opposed flat surfaces and formed on said cylindrical form and extending the length of said form, one end of said form terminating in a cylindrical flange of greater diameter than said form, an opposite end of said form having a flat surface; a plurality of diametrally opposed transverse grooves spaced along the length of said form at right angles to said pair of flat surfaces; a flat rectilinear U-shaped retaining clip of tempered material having inner edges for insertion into one pair of said opposing transverse grooves to securely hold said fitting against a panel or lamina having an opening into which said fitting is inserted, said clip having parallel leg members spaced apart equal to the spacing of the bottoms of the opposed grooves; said fitting further having at least one pair of electrical conduit wire receiving sockets in at least one of said flat surfaces, said sockets being of electrically conductive material and integral with internal integrated electrical circuitry of said fitting.

2. The fitting according to claim 1 wherein said fitting is used as a connector, said cylindrical form having a first pair of said wire sockets in said opposite end, a second pair of said wire sockets in said end flange, a third pair of said wire sockets in one of said flat surfaces and a fourth pair of said wire sockets in the other of said flat surfaces, said pairs of wire sockets being electrically interconnected by cruciform circuitry, the spacing between said sockets in each pair being the same center to center distance as the spacing between wires of a cable for connection to said fitting.

3. The fitting according to claim 1 wherein said fitting is used as an outlet, said cylindrical form having a first pair of said wire sockets in said opposite end, a second pair of said wire sockets in one of said flat surfaces and a pair of standard rectilinear plug sockets in said flange end, said first pair of said sockets and said plug sockets being electrically interconnected, said second pair of wire sockets being interconnected with said first pair of wire sockets and said plug sockets to provide an outlet that can be used in parallel with other fittings.

4. The fitting according to claim 1 wherein said fitting is used as a light socket, said cylindrical form having a pair of said wire sockets in said opposite end, said flange end having a recess therein to receive a light bulb socket and circuitry to electrically interconnect said wire sockets and said light bulb socket.

5. The fitting according to claim 1 wherein said fitting is used as a switch, said cylindrical form having a pair of said wire sockets in said opposite end and a pair of said wire sockets in one of said flat surfaces, a pair of prong sockets to accommodate a switch element having a pair of prongs of dissimilar length for insertion into said prong accommodating sockets and internal electrical circuitry interconnecting said two pairs of wire sockets and said prong accommodating sockets, said switch element having a lower portion bearing said switch element prongs and a pivotal upper portion having an element which opens and closes contact between upper ends of said prongs, said wire sockets in said opposite end and said flat surface receiving wire ends of a cable.

6. The fitting according to claim 1 wherein each of said legs has two parallel ridges, one ridge on each leg is parallel to said clip inner edge and protrudes upwardly from said edge, the other ridge on each leg being parallel to said edge and protruding downwardly with reference to said edge and being adjacent and parallel to said one ridge.

* * * * *